US005856062A

United States Patent [19]

Hoshi

[11] Patent Number: 5,856,062

[45] Date of Patent: Jan. 5, 1999

[54] LIGHT-SENSITIVE MATERIAL COMPRISING LIGHT-SENSITIVE HARDENING LAYER PROVIDED ON SUPPORT

[75] Inventor: Satoshi Hoshi, Shizuoka, Japan

[73] Assignee: Fuji Photo Film Co., Ltd., Kanagawa, Japan

[21] Appl. No.: 634,415

[22] Filed: Apr. 18, 1996

[30] Foreign Application Priority Data

Apr. 18, 1995 [JP] Japan ..... 7-117966

[51] Int. Cl.[6] ..... G03C 1/498; G03C 8/40

[52] U.S. Cl. ..... 430/203; 430/275.1; 430/278.1; 430/281.1; 430/617; 430/619; 430/635; 430/638; 430/955

[58] Field of Search ..... 430/203, 617, 430/619, 638, 215, 627, 270.1, 621, 955, 281.1, 635, 275.1, 278.1

[56] References Cited

U.S. PATENT DOCUMENTS

| | | | |
|---|---|---|---|
| 4,886,739 | 12/1989 | Przezdziecki | 430/617 |
| 5,418,120 | 5/1995 | Bauer et al. | 430/527 |
| 5,554,482 | 9/1996 | Yokoya et al. | 430/203 |

*Primary Examiner*—Thorl Chea

*Attorney, Agent, or Firm*—Sughrue, Mion, Zinn, Macpeak & Seas, PLLC

[57] ABSTRACT

A light-sensitive material comprises a light-sensitive hardening layer provided on a support. The light-sensitive hardening layer contains silver halide, a reducing agent and an ethylenically unsaturated polymerizable compound or an ethylenically unsaturated cross-linkable polymer. The light-sensitive hardening layer further contains a coupling agent in an amount of 0.01 to 15 wt. %.

9 Claims, No Drawings

LIGHT-SENSITIVE MATERIAL COMPRISING LIGHT-SENSITIVE HARDENING LAYER PROVIDED ON SUPPORT

FIELD OF THE INVENTION

The present invention relates to a light-sensitive material comprising a support and a light-sensitive hardening layer containing silver halide, a reducing agent and an ethylenically unsaturated polymerizable compound or an ethylenically unsaturated cross-linkable polymer.

BACKGROUND OF THE INVENTION

U.S. Pat. Nos. 4,629,676 (Hayakawa et al) and No. 4,859,568 (Takeda) disclose an image forming method comprising the steps of imagewise exposing to light a light-sensitive material, and heating the light-sensitive material. The light-sensitive material comprises a support and a light-sensitive hardening layer containing silver halide, a reducing agent and a polymerizable compound. The light-sensitive material is heated to develop the silver halide and to harden the polymerizable compound.

U.S. Pat. Nos. 5,122,443 (Takeda), No. 5,290,659 (Takeda) and No. 5,393,651 (Hoshi) disclose embodiments of the above-mentioned light-sensitive material, which are advantageously used for the preparation of a lithographic plate. U.S. Pat. Nos. 5,304,454 (Yokoya et al), No. 5,326,667 (Yokoya et al) and No. 5,328,800 (Yokoya et al) disclose other embodiments of the light-sensitive material, which are advantageously used for the preparation of a color proof. In the light-sensitive materials for the lithographic plate or the color proof, a cross-linkable polymer can be used in place of or in addition to the polymerizable compound. Further, the light-sensitive hardening layer preferably comprises a hardening layer containing the polymerizable compound or the cross-linkable polymer and a light-sensitive layer containing silver halide. An overcoating layer containing a base precursor may be provided on the light-sensitive layer.

In the above-mentioned image forming methods, some components of the light-sensitive material form a gas. In the case that an acylhydrazine compound (disclosed in U.S. Pat. No. 4,859,568) is used as a reducing agent, the oxidation product of the compound forms nitrogen gas after reducing silver halide. Further, the base precursor is usually in the form of a carboxylic acid and a base. The carboxylic acid in the base precursor is decarboxylated under heating to release carbon dioxide gas as well as the base.

SUMMARY OF THE INVENTION

The applicant has studied the image forming method using a heat development. As a result, the applicant notes two problems in the obtained image. First, omissions are sometimes observed in the obtained hardened image. Second, spots of the polymerizable compound or the cross-linkable polymer remain in the unhardened area.

The applicant has further studied the cause of the problems. Finally, the applicant finds that the problems are caused by a gas formed at the image forming process. The formed gas destroys the hardened area to cause the first problem. The gas also presses a polymerizable compound or a cross-linkable polymer on the support to cause the second problem. The problems are particularly serious in the case that a light-sensitive layer or an overcoating layer contains a polymer having a low permeability to a gas (e.g., polyvinyl alcohol having a saponification degree of not less than 80%).

An object of the present invention is to provide a light-sensitive material that can form a clear image.

Another object of the invention is to solve the problems of the omissions in the hardened area and the remaining spots in the unhardened area.

The present invention provides a light-sensitive material which comprises a light-sensitive hardening layer provided on a support, said light-sensitive hardening layer containing silver halide, a reducing agent and an ethylenically unsaturated polymerizable compound or an ethylenically unsaturated cross-linkable polymer, wherein the light-sensitive hardening layer further contains a coupling agent in an amount of 0.01 to 15 wt. %.

According to the study of the applicant, the coupling agent contained in the light-sensitive polymerizable layer has a function of enhancing the mechanical strength of the hardened area as well as the unhardened area appropriately. Accordingly, the coupling agent can suppress the influence of a gas on the image.

The problems of the omissions in the hardened area and the remaining spots in the unhardened area are now solved by the excellent function of the coupling agent. Therefore, the light-sensitive material of the present invention can form a clear image.

DETAILED DESCRIPTION OF THE INVENTION

The present invention is characterized in that the light-sensitive hardening layer contains a coupling agent in an amount of 0.01 to 15 wt. %.

The coupling agent is a compound having a function of enhancing the bond or the affinity along an interface between two substances. The coupling agent is usually used to improve mechanical strength, water-resistance and heat35 resistance of a complex material. The bond in the complex material is enhanced by a chemical bond (covalent bond, hydrogen bond, ionic bond or van der Waals force) between the coupling agent and the substances.

The coupling agent is well known in the technical field of a material, particularly a plastic material. The coupling agent has been mainly used to improve adhesion between inorganic and organic substances. Further, the coupling agent has recently been used to improve a characteristic of a resin (strength, adhesion or durability). The coupling agent is also used to improve a surface characteristic of a substance to disperse it well or to form an antistatic surface. Various compounds have been proposed as the coupling agent. The coupling agent usually is an organometal compound that has a centered metal atom (e.g., Si, Al, Ti) and a group to be hydrolyzed (e.g., alkoxy, acetoxy, ketoxime, isoprepenoxy). The coupling agent also usually is a compound of a low molecular weight, which is in the form of liquid at ordinary temperatures. The coupling agent may be used in a thermally processable imaging element to improve the adhesion between two layers. For example, U.S. Pat. No. 4,886,739 (Przezdziecki) discloses a photothermographic (or thermographic) imaging element comprising a support bearing at least one photothermographic layer comprising a thermographic imaging composition and 2.5 to 20% by weight of the layer of at least one hydrolyzed polyalkoxysilane (silane coupling agent).

In the present invention, the function of the coupling agent is different from the above-mentioned usual functions. The coupling agent used in the present invention hardens the light-sensitive hardening layer (or the hardening layer) appropriately. The coupling agent preferably is a silane coupling agent, an aluminum coupling agent, a titanate coupling agent or a zircoaluminate coupling agent.

A preferred silane coupling agent is represented by the following formula (Ia), (Ib), (Ic), (Id) or (Ie).

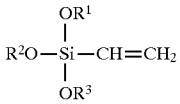

(Ia)

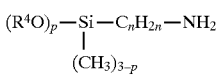

(Ib)

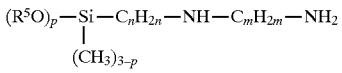

(Ic)

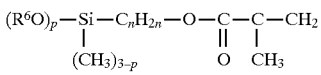

(Id)

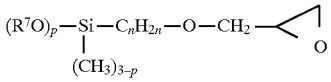

(Ie)

In the formulas (Ia), (Ib), (Ic), (Id) and (Ie), each of $R^1$, $R^2$, $R^3$, $R^4$, $R^5$, $R^6$ and $R^7$ independently is an alkyl group having 1 to 4 carbon atoms (e.g., methyl, ethyl) or an alkoxyalkyl group having 2 to 4 carbon atoms (e.g., methoxyethyl). The alkyl group is preferred to the alkoxyalkyl group. The alkyl group and the alkyl moieties of the alkoxyalkyl group preferably have a chain structure rather than a cyclic structure. The chain structure can be straight or branched.

In the formulas (Ib), (Ic), (Id) and (Ie), n is 2 or 3.

In the formula (Id), m is 2 or 3.

In the formulas (Ib), (Ic), (Id) and (Ie), p is 2 or 3.

A preferred aluminum coupling agent is represented by the following formula (IIa), (IIb) or (IIc). The compound represented by the formula (IIa) is an aluminum alcoholate. The compound represented by the formula (IIb) is an aluminum chelate. The compound represented by the formula (IIc) is a cyclic aluminum oligomer.

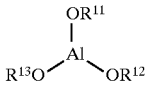

(IIa)

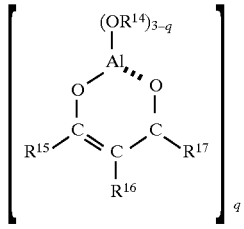

(IIb)

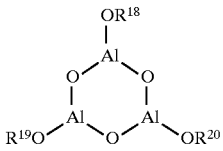

(IIc)

In the formulas (IIa) and (IIb), each of $R^{11}$, $R^{12}$, $R^{13}$ and $R^{14}$ independently is an alkyl group having 2 to 18 carbon atoms (e.g., ethyl, isopropyl, sec-butyl, dodecyl). The alkyl group preferably has a chain structure rather than a cyclic structure. The chain structure can be straight or branched.

In the formula (IIb), $R^{15}$ is an alkyl group having 1 to 18 carbon atoms (e.g., methyl, ethyl, hexyl). The alkyl group preferably has a chain structure rather than a cyclic structure. The chain structure can be straight or branched.

In the formula (IIb), $R^{16}$ is hydrogen or an alkyl group having 1 to 6 carbon atoms (e.g., methyl, ethyl). Hydrogen is preferred to the alkyl group. The alkyl group preferably has a chain structure rather than a cyclic structure. The chain structure can be straight or branched.

In the formula (IIb), $R^{17}$ is an alkyl group having 1 to 18 carbon atoms (e.g., methyl, ethyl, octyl) or an alkoxy group having 1 to 18 carbon atoms (e.g., methoxy, ethoxy, butoxy). The alkyl group and the alkyl moiety of the alkoxy group preferably have a chain structure rather than a cyclic structure. The chain structure can be straight or branched.

In the formula (IIc), each of $R^{18}$, $R^{19}$ and $R^{20}$ independently is an alkyl group having 2 to 18 carbon atoms (e.g., ethyl, isopropyl, sec-butyl) or an acyl group having 2 to 18 carbon atoms (e.g., acetyl, propionyl). The alkyl group and the alkyl moiety of the acyl group preferably have a chain structure rather than a cyclic structure. The chain structure can be straight or branched.

In the formula (IIb), q is 1, 2 or 3.

A preferred titanate coupling agent represented by the following formula (IIIa), (IIIb), (IIIc) or (IIId).

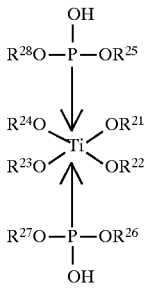

(IIIa)

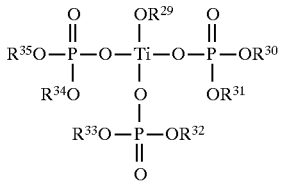

(IIIb)

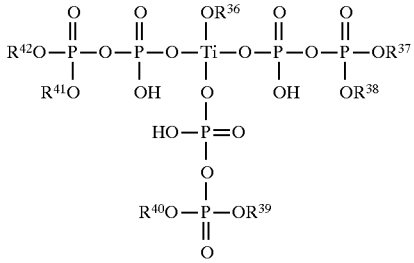

(IIIc)

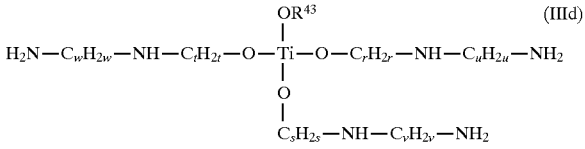

(IIId)

In the formulas (IIIa), (IIIb), (IIIc) and (IIId), each of $R^{21}$, $R^{22}$, $R^{23}$, $R^{24}$, $R^{25}$, $R^{26}$, $R^{27}$, $R^{28}$, $R^{29}$, $R^{30}$, $R^{31}$, $R^{32}$, $R^{33}$, $R^{34}$, $R^{35}$, $R^{36}$, $R^{37}$, $R^{38}$, $R^{39}$, $R^{40}$, $R^{41}$, $R^{42}$ and $R^{43}$ independently is an alkyl group having 1 to 18 carbon atoms (e.g., methyl, ethyl, isopropyl, butyl, sec-butyl). The alkyl group preferably has a chain structure rather than a cyclic structure. The chain structure can be straight or branched.

In the formula (IIId), each of r, s, t, u, v and w independently is 1, 2 or 3.

A preferred zircoaluminate coupling agent is represented by the following formula (IV).

(IV)

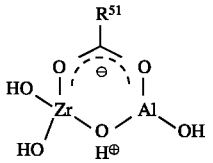

In the formula (IV), $R^{51}$ is an alkyl group having 1 to 18 carbon atoms (e.g., ethyl, isopropyl, tridecyl), an aminoalkyl group having 1 to 18 carbon atoms (e.g., aminoethyl), a carboxyalkyl group having 2 to 18 carbon atoms (e.g., carboxypropyl) or a mercaptoalkyl group having 1 to 18 carbon atoms (e.g., mercaptoethyl). The alkyl group and the alkyl moieties of the substituted alkyl groups preferably have a chain structure rather than a cyclic structure. The chain structure can be straight or branched.

Examples of the silane coupling agent (I), the aluminum coupling agent (II), the titanate coupling agent (III) and the zircoaluminate coupling agent (IV) are shown below.

(I-1)

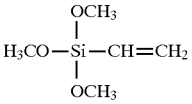

(I-2)

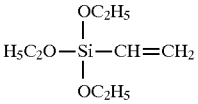

(I-3)

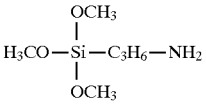

(I-4)

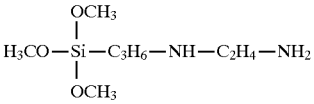

(I-5)

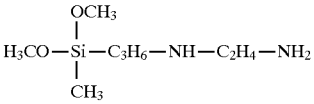

(I-6)

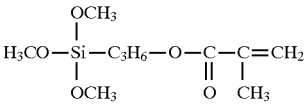

(I-7)

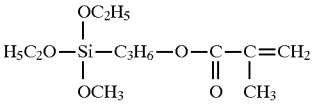

(I-8)

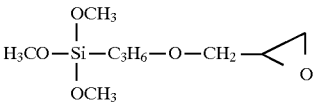

(I-9)

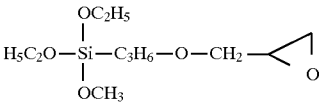

-continued (II-1)

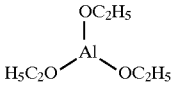

(II-2)

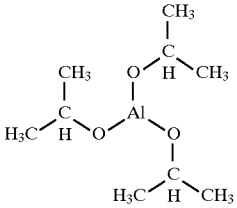

(II-3)

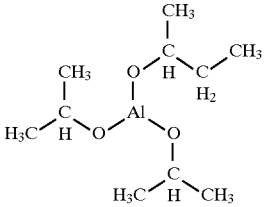

(II-4)

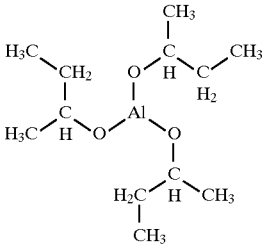

(II-5)

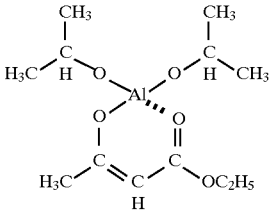

(II-6)

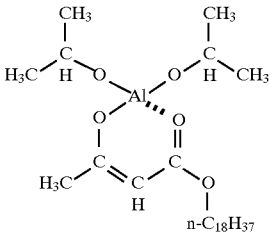

(II-7)

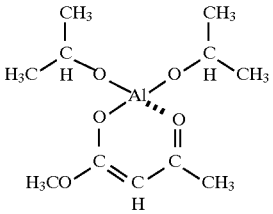

-continued
(II-8)
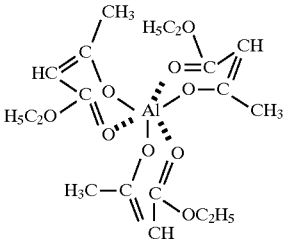
(II-9)
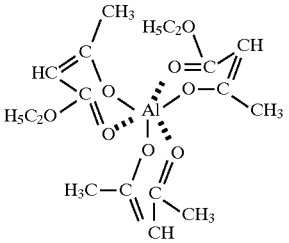
(II-10)
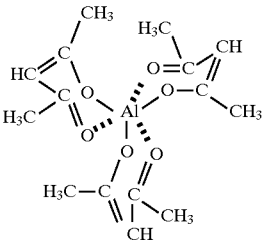
(II-11)
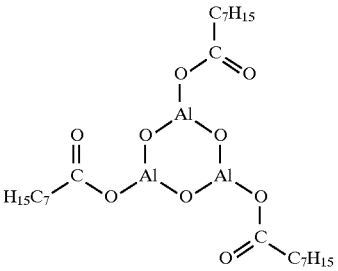
(II-12)
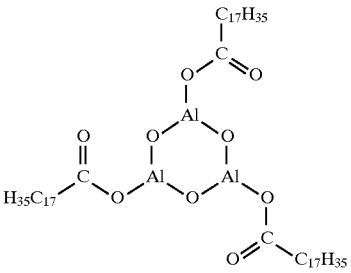
(II-13)
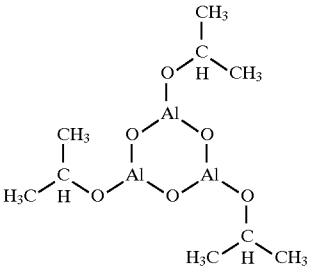
-continued
(III-1)
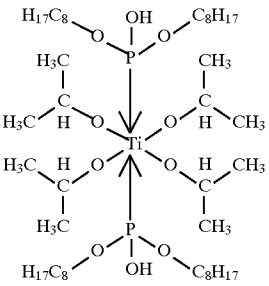
(III-2)
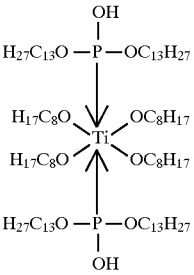
(III-3)
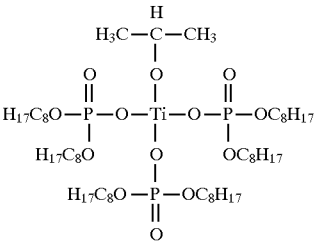
(III-4)
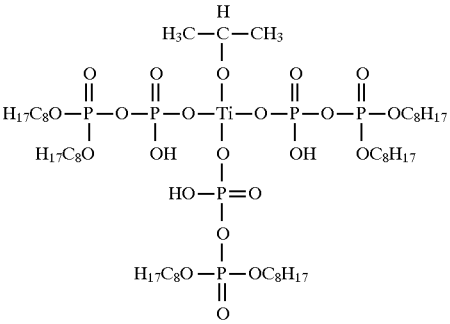
(III-5)
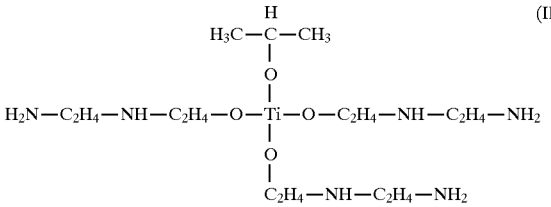
(IV-1)
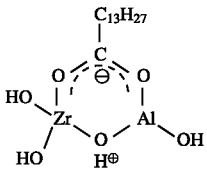

-continued

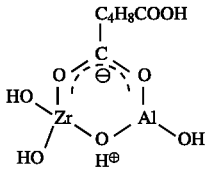

(IV-2)

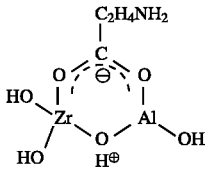

(IV-3)

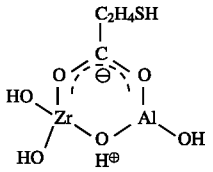

(IV-4)

The coupling agent has been used according to a wet method or a dry method. The wet method is preferably used in the present invention. In more detail, a solution or a suspension of a coupling agent is added to a coating solution of a light-sensitive hardening layer. The mixture is well stirred, coated and dried to form the light-sensitive hardening layer containing the coupling agent.

The amount of the coupling agent is 0.01 to 15 wt .% based on the total amount of the light-sensitive hardening layer. The total amount means the sum of the light-sensitive layer and the hardening layer in the case that the light-sensitive polymerizable layer is divided into the two layers. The amount of the other layers such as an overcoating layer is not included in the total amount. The amount of the coupling agent is preferably in the range of 0.05 to 10 wt. %. If the amount is less than 0.01 wt. %, the effect of the coupling agent is insufficient for obtaining a clear uniform image. If the amount is more than 15 wt. %, the unhardened area is set to remain in the obtained image.

In the case that the light-sensitive hardening layer contains a polymer (a binder or a cross-linkable polymer), the amount of the coupling agent is preferably in the range of 0.5 to 60 wt. %, and more preferably in the range of 0.1 to 30 wt. % based on the amount of the polymer.

The layered structure, the components and the image forming method of the light-sensitive material of the present invention are described below.

[Layered structure]

The light-sensitive material of the present invention comprises light-sensitive hardening layer provided on a support. The light-sensitive hardening layer preferably comprises a hardening layer and a light-sensitive layer. The hardening layer contains the coupling agent and an ethylenically unsaturated polymerizable compound or an ethylenically unsaturated cross-linkable polymer. The light-sensitive layer contains silver halide. A reducing agent is contained in the hardening layer or the light-sensitive layer. The light-sensitive material more preferably comprises the support, the hardening layer and the light-sensitive layer in that order.

Further, the light-sensitive material may have other optional layers such as an overcoating layer, an adhesive layer and a strippable layer.

[Light-sensitive layer]

The light-sensitive layer contains silver halide, which forms a radical after an exposing step and a developing step. The formed radical is transferred to a hardening layer to cause a hardening reaction.

The light-sensitive layer preferably has a thickness in the range of 0.1 to 20 μm, and more preferably in the range of 0.5 to 10 μm.

[Hardening layer]

The hardening layer contains an ethylenically unsaturated polymerizable compound or an ethylenically unsaturated cross-linkable polymer as well as the coupling agent. The hardening layer is hardened by a polymerization reaction or a cross-linking reaction.

The hardening layer preferably has a thickness in the range of 0.1 to 20 μm, and more preferably in the range of 0.3 to 7 μm.

[Overcoating layer]

An overcoating layer has a function of preventing oxygen in the air from permeating into the hardening layer. Oxygen functions as a polymerization inhibitor. Accordingly, the hardness of the hardening layer can be improved by providing the overcoating layer. The overcoating layer can also function as a protective layer. The overcoating layer may contain a component (e.g., a base precursor, a reducing agent, a heat development accelerator) that accelerates an image forming reaction.

The overcoating layer may contain a matting agent, which has a function of reducing adhesion on the surface of the light-sensitive material to prevent adhesion when the materials are stacked.

The overcoating layer is usually made of a hydrophilic polymer. The layer preferably has a thickness in the range of 0.3 to 20 μm, and more preferably in the range of 0.5 to 10 μm.

[Adhesive layer]

An adhesive layer can be provided in the light-sensitive material to form a toner image. The adhesive layer contains a polymer, to which toner particles adhere.

The adhesive polymer preferably is a natural or synthetic rubber. Examples of the synthetic rubbers include polyisobutylene, nitryl rubber, butyl rubber, chlorinated rubber, polyvinyl isobutyl rubber, silicon elastomer, neoprene and a copolymer rubber (e.g., styrene-butadiene copolymer, styrene-isobutylene copolymer). The copolymer may be any of a random copolymer, a block copolymer and a graft copolymer.

The adhesive layer preferably has a thickness in the range of 0.01 to 10 μm, and more preferably in the range of 0.05 to 5 μm.

[Strippable layer]

A strippable layer can be provided in the light-sensitive material to form a transferred image.

The strippable layer is not adhesive at room temperature so that it is easily removed from the support. The layer is usually adhesive at an elevated temperature. The strippable layer usually contains an organic polymer (e.g., polyvinyl acetal resin, polyamide resin) as matrix. The matrix polymer preferably has a flow softening point that is higher than a heating temperature required for developing silver halide.

The strippable layer preferably contains a fluorine compound in an amount of not less than 1 wt. %. A fluorine surface active agent is preferably used as the fluorine compound. The strippable layer preferably has a thickness of not less than 1.0 μm, and more preferably of not less than 1.4 μm.

[Intermediate layer]

An intermediate layer can be provided between the layers.

The intermediate layer can function as an antihalation layer or a barrier layer. The barrier layer prevents components from moving between layers when the light-sensitive material is stored. The composition of the intermediate layer is determined according to its function. The intermediate layer can be made of a hydrophilic polymer used in the light-sensitive layer or the overcoating layer.

The intermediate layer preferably has a thickness of not more than 10 μm.

[Support]

The support can be made of a paper, a synthetic paper, a paper laminated with a synthetic resin (e.g., polyethylene, polypropylene, polystyrene), a plastic film (e.g., polyethylene terephthalate, polycarbonate, polyimide, Nylon, cellulose triacetate), a metal plate (e.g., aluminum, aluminum alloy, zinc, iron, copper) or a paper or plastic film laminated with the metal. Further, the metal can be evaporated onto the paper or plastic film to form the support.

In the case that the light-sensitive material is used for the preparation of a lithographic plate, the support is preferably made of an aluminum plate, a polyethylene terephthalate film, a polycarbonate film, a paper or a synthetic paper. A complex sheet can also be available. For example, an aluminum sheet can be laminated on the polyethylene terephthalate film.

Aluminum support is particularly preferred. The aluminum support preferably has a thickness in the range of 0.1 to 0.5 mm.

The aluminum support is preferably treated to form a rough surface (graining treatment) or a hydrophilic surface.

The treatment for the rough surface can be conducted by an electrochemical graining treatment and/or a mechanical graining treatment. According to the electrochemical graining treatment, a current passes through an aluminum plate in an electrolytic solution of hydrochloric acid or nitric acid. The mechanical graining treatment includes a wire brushing method, a ball graining method and a brash graining method. In the wire brushing method, the surface of aluminum plate is scratched with a metal wire. In the ball graining method, the surface of aluminum plate is grained with graining balls and a graining agent. In the brash graining method, the surface is grained with a Nylon brash and a graining agent.

The grained aluminum plate is then chemically etched with an alkali or an acid. An alkali etching method is industrially advantageous. Examples of the alkali agents include sodium carbonate, sodium aluminate, sodium metasilicate, sodium phosphate, sodium hydroxide, potassium hydroxide and lithium hydroxide. The alkali solution preferably has a concentration in the range of 1 to 50 wt. %. The temperature of the alkali treatment is preferably in the range of 20° to 100° C. The treatment conditions are preferably so adjusted that the amount of the dissolved aluminum is in the range of 5 to 20 g/m$^2$.

The aluminum plate is usually washed with an acid to remove smut from the surface after the alkali etching treatment. Examples of the acids include nitric acid, sulfuric acid, phosphoric acid, chromic acid, hydrofluoric acid and borofluoric acid.

The smut removing treatment can also be conducted after the electrochemical graining treatment according to a conventional method. For example, an aluminum plate can be treated with 15 to 65 wt. % sulfuric acid at a temperature in the range of 50° to 90° C.

The surface treated aluminum plate can be subjected to an anodizing treatment or a chemical treatment. The anodizing treatment can be conducted according to a conventional method. In more detail, a direct or alternative current passes through an aluminum plate in a solution of an acid to form an anodic oxide layer on the surface of the plate. Examples of the acids include sulfuric acid, phosphoric acid, chromic acid, oxalic acid, sulfamic acid and benzenesulfonic acid. The conditions of the anodizing treatment depend on the contents of the electrolytic solution. The concentration of the electrolytic solution is preferably in the range of 1 to 80 wt. %, the temperature of the solution is preferably in the range of 5° to 70° C., the current density is preferably in the range of 0.5 to 60 A/dm2, the voltage is preferably in the range of 1 to 100 v, and the time for the electrolysis is preferably in the range of 10 to 100 seconds.

The anodizing treatment is preferably conducted in sulfuric acid at a high current density. Phosphoric acid is also preferably used for the anodizing treatment.

After the anodizing treatment, the aluminum plate can be treated with an alkali metal silicate. For example, the aluminum plate can be immersed in an aqueous solution of sodium silicate. An undercoating layer can be provided on the aluminum support to improve the adhesion between the support and the hardening layer or to improve a printing character.

[Undercoating layer]

Examples of the components of the undercoating layer include a polymer (e.g., casein, polyvinyl alcohol, ethyl cellulose, phenol resin, styrene-maleic anhydride resin, polyacrylic acid), an amine (e.g., monoethanol amine, diethanol amine, triethanol amine, tripropanol amine) and a salt thereof (e.g., chloride, oxalate, phosphate), an monoaminomonocarboxylic acid (aminoacetic acid, alanine), an oxyamino acid (serine, threonine, dihydroxyethylglycine), a sulfur containing amino acid (e.g., cysteine, cystine), a monoaminodicarboxylic acid (e.g., aspartic acid, glutamic acid), an amino acid having an aromatic ring (e.g., p-hydroxylphenylglycine, phenylalanine, anthranilic acid), an aliphatic aminosulfonic acid (e.g., sulfamic acid, cyclohexylsulfamic acid) and a (poly)aminopolyacetic acid (e.g., ethylenediaminetetraacetic acid, nitrilotriacetic acid, iminodiacetic acid, hydroxyethyliminodiacetic acid, hydroxyethylethylenediamineacetic acid, ethylenediaminediacetic acid, cycloethylenediaminetetraacetic acid, diethylenetriaminepentaaceitic acid, glycoletherdiaminetetraacetic acid). All or a part of the acidic groups of the above-mentioned compound may form a salt (e.g., sodium salt, potassium salt, ammonium salt). Two or more components can be used in combination.

[Silver halide]

Silver halide is silver chloride, silver bromide, silver iodide, silver chlorobromide, silver chloroiodide, silver iodobromide or silver chloroiodobromide in the form of grains.

The crystal forms of silver halide grains preferably are cubic or tetradecahedron. In addition to these regular crystals, irregular forms and mixed forms are available. Examples of the irregular forms include a potato-like form, a spherical form and a tabular form. The tabular form usually has an aspect ratio (diameter per thickness) of 5 or more.

The silver halide grains may be extremely small grains having a grain diameter (diameter of projected area) of less than 0.01 μm. The grains may also be relatively large grains having a diameter of more 10 μm. The silver halide emulsion may be a polydispersed emulsion or a monodispersed emulsion. The monodispersed emulsion is described in U.S. Pat. Nos. 3,574,628 and No. 3,655,394 and British Patent No. 1,413,748.

With respect to the crystal structure of the silver halide grains, the individual grains may have a homogeneous halogen composition or a heterogeneous halogen composition. In the heterogeneous composition, the composition varies from the outer surface portion to the inside portion.

The grains may have a multi-layered structure. Further, the silver halide grains may be bonded with other silver halide grains having different halogen composition through epitaxial bonding. The grains may be bonded with compounds other than the silver halide such as silver rhodanate and lead oxide.

Various substances in the form of salt can be added to the silver halide. Examples of the substances include copper, thallium, lead, cadmium, zinc, chalcogens (e.g., sulfur, selenium, tellurium), gold, and noble metals of group VIII (e.g., rhodium, iridium, iron, platinum, palladium). The salts are added to the emulsion at the grain formation or after the grain formation according to a conventional process. The conventional process is described in U.S. Pat. No. 1,195,432, No. 1,191,933, No. 2,448,060, No. 2,628,167, No. 2,950,972, No. 3,488,709, No. 3,737,313, No. 3,772,031, No. 4,269,927 and Research Disclosure (RD), No. 13,452 (Jun. 1975).

The silver halide grains can be doped with iridium ion by adding an aqueous solution of an iridium compound to a silver halide emulsion. Examples of water-soluble iridium compounds include hexachloroiridic(III) salts and hexachloroiridic(IV) salts. The silver halide grains can also be doped with rhodium ion by adding an aqueous solution of a rhodium compound to a silver halide emulsion. Examples of water-soluble rhodium compounds include rhodium ammonium chloride, rhodium trichloride and rhodium chloride.

The iridium compound or the rhodium compound can be dissolved in a halide solution for forming silver halide grains. The aqueous solution of the iridium compound or the rhodium compound can be used before or after the grain formation. Further, the solution can be added to the emulsion between the grain formation and a chemical sensitization. The solution is preferably added at the stage of the grain formation. The iridium or rhodium ion is preferably used in an amount of $10^{-8}$ to $10^{-3}$ mol, and more preferably in an amount of $10^{-7}$ to $10^{-5}$ mol based on 1 mol of silver halide. In the case that iridium compound and the rhodium compound are used in combination, the rhodium compound is preferably added to the emulsion before the addition of the iridium compound.

Two or more kinds of silver halide grains that differ in halogen composition, crystal habit, grain size, or other features from each other can be used in combination.

The silver halide is preferably used in the form of an emulsion. The silver halide emulsion can be prepared by known processes, which are described in Research Disclosure (RD), No. 17,643, pages 22 to 23 (December 1978), (Emulsion preparation and types); and Research Disclosure, No. 18,716, p. 648, (November 1979).

The silver halide emulsion is generally used after a physical ripening and a chemical sensitization.

Various additives can be used in the ripening or sensitizing steps. The additives are described in Research Disclosure, No. 17,643 and No. 18,716. The chemical sensitizer is described in No. 17,643 (page 23) and No. 18,716 (page 648, right column). Other additives are also described in Research Disclosure. For example, a sensitivity-increasing agent is described in No. 18,716 (page 648, right column). An anti-fogging agent and a stabilizer are described in No. 17,643 (pages 24 to 25) and No. 18,716 (page 649, right column), respectively.

The silver halide emulsion is usually subjected to a spectral sensitization. Various spectral sensitizing dyes are known in a conventional silver halide photography. Examples of the sensitizing dyes include cyanine dyes, merocyanine dyes, complex merocyanine dyes, holopolar cyanine dyes, hemicyanine dyes, styryl dyes and hemioxonol dyes.

A supersensitizer can be added to the emulsion in addition to the sensitizing dye. The supersensitizer itself has neither a spectral sensitization effect nor an absorption of visible light, but shows a supersensitizing effect on the sensitizing dye.

[Organic metallic salt]

An organic metallic salt can be added to the light-sensitive layer containing silver halide. An organic silver salt is particularly preferred.

Examples of organic moieties of the salts include triazoles, tetrazoles, imidazoles, indazoles, thiazoles, thiadiazoles, azaindenes. An aliphatic, aromatic or heterocyclic compound having a mercapto group is also available as the organic moiety. Further, silver carboxylates and acetylene silver are available as the organic silver salt. Two or more organic metallic salts can be used in combination.

The organic silver salt is generally used in an amount of $10^{-5}$ to 10 mol, and preferably $10^{-4}$ to 1 mol based on 1 mol of silver halide. A similar effect can be obtained by adding the organic moiety of the organic metallic salt in place of the salt itself to the light-sensitive layer containing silver halide. The organic moiety can partially react with the silver halide to form the organic metallic salt.

[Reducing agent]

The reducing agent has a function of reducing the silver halide or a function of accelerating (or inhibiting) a hardening reaction of the polymerizable compound or the cross-linkable polymer. There are known various reducing agents having the functions. Examples of the reducing agents include hydroquinones, catechols, p-aminophenols, p-phenylenediamines, 3-pyrazolidones, 3-aminopyrazoles, 4-amino-5-pyrazolones, 5-aminouracils, 4,5-dihydroxy-6-aminopyrimidines, reductones, aminoreductones, o- or p-sulfonamidophenols, o- or p-sulfonamidonaphthols, 2,4-disulfonamidephenols, 2,4-disulfonamidenaphthols, o- or p-acylaminophenols, 2-sulfonamidoindanones, 4-sulfonamido-5-pyrazolones, 3-sulfonamidoindoles, sulfonamidopyrazolobenzimidazoles, sulfonamidopyrazolotriazoles, αsulfonamidoketones and hydrazines.

The reducing agents (including compounds referred to as developing agent or hydrazine derivative) are described in Japanese Patent Provisional Publications 61(1986)183640, No. 61(1986)-183535, No. 61(1986)-228441, No. 62(1987)-70836, No. 61(1987)-86354, No. 62(1987)-86355, No. 62(1987)-206540, No. 62(1987)-264041, No. 62(1987)-109437 and No. 63(1988)-254442, and Japanese Patent Applications No. 63(1988)-97379, No. 63(1988)-296774, No. 63(1988)-296775, No. 1(1989)-27175, No. 1(1989)-54101 and No. 1(1989)-91162. The reducing agents are also described in T. James, The Theory of the Photographic Process, 4th edition, pages 291 to 334 (1977), Research Disclosure, Vol. 170, No. 17029, pages 9 to 15 (June 1978), and Research Disclosure, Vol. 176, No. 17643, pages 22 to 31 (December 1978). Further, a reducing agent precursor is also available. The precursor can release a reducing agent under heating or in contact with a base.

When the reducing agent is basic, that is, it forms a salt with an acid, the reducing agent can be used in the form of a salt with an acid. The reducing agents can be used singly or in combination. Certain interactions between those reducing agents may be expected where two or more reducing agents are used in combination. One of the interactions is for an acceleration of reduction of silver halide (or an organic silver salt) through so-called super-additivity. The other interaction is for a chain reaction between an oxidant of one reducing agent formed by a reduction of silver halide (or an organic silver salt) oxidation-reduction reaction and another reducing agent. The chain reaction induces or inhibits the polymerization of the polymerizable compound. Both interactions may occur simultaneously. Thus, it is difficult to determine which of the interactions has occurred in practical use.

The reducing agent is used in an amount of 0.1 to 10 mol, and more preferably 0.25 to 2.5 mol based on 1 mol of silver halide.

By adjusting the kind or amount of the above reducing agent, the polymerizable compound or the cross-linkable polymer can be hardened within the area where a latent image of the silver halide has been formed.

The reducing agent itself can be oxidized to form an oxidation product when the reducing agent develops silver halide. In the case that the oxidation product is decomposed in the layer to form a radical, a polymerization reaction proceeds within the area where the latent image of silver halide has been formed. In this system, hydrazines are preferably used as the reducing agent.

On the other hand, the reducing agent itself or the oxidation product may have a function of inhibiting the polymerization. In this case, the oxidation product substantially does not form a radical. A polymerization is caused by a polymerization initiator within the area where the latent image of silver halide has not been formed (in the case that the inhibiting function of the oxidation product is stronger than that of the reducing agents) or has been formed (in the case that the inhibiting function of the reducing agent is stronger than that of the oxidation products). In these systems, 1-phenyl-3-pyrazolidones and hydroquinones are preferably used as the reducing agent. Further, the following polymerization initiator should be contained in the light-sensitive material of these systems.

[Polymerization initiator]

A thermal polymerization initiator forms a free radical by heat. The radical is added to the polymerizable compound or the cross-linkable polymer.

The thermal polymerization initiator is described in Addition Polymerization and Ring Opening Polymerization, pages 6 to 18, edited by the Editorial Committee of High Polymer Experimental Study of the High Polymer Institute, published by Kyoritsu Shuppan (1983). Examples of the thermal polymerization initiators include azo compounds (e.g., azobisisobutyronitrile, 1,1'-azobis(1-cyclohexanecarbonitrile)) and peroxides.

A photopolymerization initiator forms a free radical by light. The radical is added to the polymerizable compound or the cross-linkable polymer.

The photopolymerization initiator is described in Oster et al., Chemical Review, vol. 68, pages 125 to 151 (1968), Kosar, Light-Sensitive System, pages 158 to 193, John Wiley & Sons (1965), Japanese Patent Provisional Publications No. 61(1986)-75342 and No. 2(1990)-207254. Examples of the photopolymerization initiator include carbonyl compounds, halogen-containing compounds, redox couples of photo-reducible dye and reducing agent, organic sulfur compounds, peroxides, photo semi-conductors and metallic compounds.

The polymerization initiator is used in an amount of preferably 0.001 to 0.5 g, and more preferably 0.01 to 0.2 g based on 1 g of the total amount of the polymerizable compound and the cross-linkable polymer.

[Polymerizable compound]

The polymerizable compound used in the present invention has an ethylenically unsaturated group.

Examples of the ethylenically unsaturated polymerizable compounds include acrylic acids, salts of acrylic acids, acrylic esters, acrylamides, methacrylic acids, salts of methacrylic acids, methacrylic esters, methacrylamides, maleic anhydride, maleic esters, itaconic esters, styrenes, vinyl ethers, vinyl esters, N-vinyl heterocyclic compounds, allyl ethers, allyl esters, and derivatives thereof. Acrylic esters and methacrylic esters are preferred.

Examples of the acrylic esters include pentaerythritol tetraacrylate, trimethylolpropane triacrylate, dipentaerythritol hexacrylate, polyester acrylate and polyurethane acrylate.

The polymerizable compound is preferably contained in the hardening layer in an amount of 3 to 90 wt. % based on the total amount of the hardening layer. The amount is more preferably in the range of 15 to 60 wt. %. Two or more polymerizable compounds can be used in combination.

[Polymer contained in hardening layer]

The hardening layer can contain a cross-linkable polymer. The cross-linkable polymer can be used in combination with another (non-cross-linkable) polymer.

The cross-linkable polymer has an ethylenically unsaturated bond in its main chain or side chain. The polymer may be a copolymer of an ethylenically unsaturated monomer with another monomer.

Examples of the polymer having an ethylenically unsaturated bond in its main chain include poly-1,4-butadiene, poly-1,4-isoprene and natural or synthetic rubbers.

Examples of the polymer having an ethylenically unsaturated bond in its side chain include poly-1,2-butadiene and poly-1,2-isoprene.

Further, a polymer of acrylic or methacrylic ester or amide having a specific residue is also available as the cross-linkable polymer. The specific residue means R of —COOR (ester) or —CONHR (amide). Examples of the specific residues include $—(CH_2)_n—CR^1{=}CR^2R^3$, $—(CH_2O)_n—CH_2CR^1{=}CR^2R^3$, $—(CH_2CH_2O)_n—CH_2CR^1{=}CR^2R^3$, $—(CH_2)_n—NH—CO—O—CH_2CR^1{=}CR^2R^3$, $—(CH_2)_n—O—CO—CR^1{=}CR^2R^3$ and $—(CH_2CH_2O)_n—X$. In the formulas, each of $R^1$, $R^2$ and $R^3$ independently is hydrogen, a halogen atom, an alkyl group, an aryl group, an alkoxy group and aryloxy group. The number of the carbon atoms contained in $R^1$, $R^2$ or $R^3$ is not more than 20. $R^1$ and $R^2$ or $R^3$ may be combined to form a ring. In the formulas, n is an integer of 1 to 10. X is dicyclopentadienyl. Examples of the ester residues include $—CH_2CH_2O—CH_2CH{=}CH_2$, $—CH_2C(CH_3){=}CH_2$, $—CH_2CH{=}CH—C_6H_5$, $—CH_2CH_2OCOCH{=}CH—C_6H_5$, $—CH_2CH_2—NHCOO—CH_2CH{=}CH_2$ and $—CH_2CH_2O—X$ (wherein X is dicyclopentadienyl). Examples of the amide residues include $—CH_2CH{=}CH_2$, $—CH_2CH_2—1—Y$ (wherein Y is cyclohexene) and $—CH_2CH_2—OCO—CH{=}CH_2$.

The cross-linkable polymer is hardened by adding a free radical to the unsaturated bond (or group). The free radical functions as a polymerization initiator or a chain extender. The polymers are cross-linked with each other directly or by a chain reaction of a polymerizable compound. The polymer can also be cross-linked by a reaction of polymer radicals, which are formed by detaching an atom of the polymers (e.g., hydrogen attached to carbon adjacent to the unsaturated bond) by a free radical.

Examples of the non-cross-linkable polymers include polyacrylic esters, polymethacrylic esters, polyvinyl acetate, polyvinyl chloride, polyvinylidene chloride, polyacrylonitrile, polymethacrylonitrile, polyethylene, polyvinyl pyridine, polyvinyl imidazole, polyvinyl butyral, polyvinyl formal, polyvinyl pyrrolidone, chlorinated polyethylene, chlorinated polypropylene, polyesters, polyamides, polyurethanes, polycarbonates, ethyl cellulose, triacetyl cellulose, diacetyl cellulose and cellulose acetate butyrate. A copolymer is also available. Two or more repeating units of the above-mentioned polymers can be used to form the copolymer.

Synthetic homopolymers and copolymers formed by an addition reaction (including various vinyl polymers) are available. Synthetic homopolymers and copolymers formed by a condensed reaction (including polyesters, polyamides, polyurethanes and mixed polymers thereof) are also available.

In the case that an alkaline solution or an aqueous solution is used to remove the unhardened area, the polymer used in the hardening layer preferably contains an acidic functional group or a hydrophilic functional group in its molecule. The acidic functional group is preferred to the hydrophilic functional group. Examples of the acidic functional groups include carboxyl, an acid anhydride group, phenolic hydroxyl, sulfo, sulfonamido and sulfonimido. An example of the hydrophilic functional group is alcoholic hydroxyl. Examples of the acidic monomers include acrylic acid, methacrylic acid, styrenesulfonic acid and maleic anhydride. The amount of the monomer having the acidic functional group or the hydrophilic functional group is preferably in the range of 1 to 60 mol %, and more preferably in the range of 5 to 40 mol %.

The polymer of the hardening layer most preferably is a copolymer consisting of a monomer having a cross-linkable group and a monomer having an acidic group.

The molecular weight of the polymer is preferably in the range of 1,000 to 500,000. Two or more polymers may be used in combination. The content of the polymer in the hardening layer is preferably in the range of 10 to 90 wt. %, and more preferably in the range of 30 to 80 wt. %.

[Hydrophilic polymer]

A hydrophilic polymer is preferably added as a binder to a hydrophilic layer, such as a light-sensitive layer and an overcoating layer.

The hydrophilic binder has a hydrophilic group or a hydrophilic bond in its molecule. Examples of the hydrophilic group include carboxyl, hydroxyl (including alcohol and phenol), sulfo, sulfonamido, sulfonimido and amido. Examples of the hydrophilic bond include urethane bond, ether bond and amido bond.

The hydrophilic binder preferably is soluble in water or swells in water. The polymer that swells in water has an affinity with water, but is not soluble in water because of the cross-linking structure of the polymer.

The natural or synthetic polymers can be used as the hydrophilic binder. The hydrophilic polymers are described in Japanese Patent Provisional Publication No. 5(1993) 249667.

Polyvinyl alcohol is preferably used as the hydrophilic polymer. Polyvinyl alcohol preferably has a high saponification degree of not less than 50%, more preferably of not less than 80% to decrease the transmission coefficient of oxygen.

A copolymerized polyvinyl alcohol is available. A copolymer of vinyl acetate and another monomer is saponified to form the denatured polyvinyl alcohol. Examples of the monomer copolymerized with the vinyl acetate include ethylene, a higher vinyl carboxylate, a higher alkyl vinyl ether, methyl methacrylate and acrylamide.

Polyvinyl alcohol may also be denatured after the saponification. Hydroxyl in polyvinyl alcohol can be modified by etheration, esterification or acetylation.

The molecular weight of the hydrophilic polymer is preferably in the range of 3,000 to 500,000. The hydrophilic polymer binder is preferably used in an amount in the range of 0.05 g to 20 g/m$^2$, and more preferably in the range of 0.1 to 10 g/m$^2$.

Gelatin can be used in combination with another hydrophilic polymer in a light-sensitive layer containing silver halide. In this case, the difference between the pH value of the layer and the isoelectric point of the gelatin is preferably larger than 1.2.

[Base or base precursor]

The light-sensitive material preferably contains a base or a base precursor. The base precursor is preferred to the base.

Preferred examples of the base precursors include salts of organic acids with bases that is decarboxylated under heating and urea compounds which release bases under heating. Examples of the reaction mechanisms of the base precursor include a reaction between the base precursor and a salt containing anion having higher compatibility with transition metal acetylide or transition metal ion than acetylide anion, and a reaction of introducing into water both of a basic metallic compound which is hardly dissolved in water and a compound capable of reacting with metal ion of the basic metallic compound in a water medium to form a complex salt so as to release a base through a reaction between those two compounds in the presence of water.

The base precursor preferably releases a base at a temperature in the range of 50 to 200° C., and more preferably in the range of 80 to 160° C. The base precursor is preferably in the form of a water-insoluble salt.

The base precursor can be used in an amount of preferably 0.1 to 20 mol, and more preferably 0.2 to 10 mol based on 1 mol of silver halide.

[Heat development accelerator]

The light-sensitive material can contain a heat development accelerator. The heat development accelerator may be contained in any layers of the light-sensitive material. The heat development accelerator has a function of increasing the plasticity of a polymer (contained in the hardening layer or the light-sensitive layer). The accelerator has another function of accelerating the dispersion of the components in the layers when it is dissolved by heat of the development process.

The heat development accelerator has been known as a plasticizer. The known plasticizers are described in Plastic Additives (written in Japanese), pages 21 to 63 (Taisei-sha); Plastics Additives, Second Edition; Hanser Publishers, Chapter 5, pages 251 to 296; Thermoplastic Additives, Marcel Dekker Inc., Chapter 9, pages 345 to 379; Plastic Additives, An Industrial Guide, Noyes Publications, Section 14, pages 333 to 485: The Technology of Solvents and Plasticizers, John Wiley & Sons, Inc., Chapter 15, pages 903 to 1027; Industrial Plasticizers, Pergamon Press; Plasticizer Technology, Vol. 1, Reinhold Publishing corp.; and Plasticization and Plasticizer Process, American Chemistry.

Examples of the heat development accelerator include glycols (e.g., diethylene glycol, dipropylene glycol), polyhydric alcohols (e.g., glycerol, butanediol, hexanediol), saccharides, formates, ureas (e.g., urea, diethylurea, ethyleneurea, propyleneurea), a urea resin, a phenol resin, amides (e.g., acetamide, propionamide) and sulfonamides. Two or more heat development accelerators can be used in combination. The heat development accelerators can be added to two or more layers of the light-sensitive material.

The amount of the heat development accelerator is preferably in the range of 0.05 to 2 g/m$^2$, and more preferably in the range of 0.1 to 1 g/m$^2$.

[Colorant]

The light-sensitive material may contain a colorant. The colorant can function as an antihalation or antiirradiation dye. Further, a hardened image can be colored by the colorant. Various known dyes and pigments are available as the colorant provided that the colorant does not affect the sensitivity and the developing reaction of silver halide. The colorant can be contained in the hardening layer in the case that the colorant is used to function as an antihalation dye or to color a hardened image. The colorant can also be contained in the light-sensitive layer in the case that the colorant is used to function as an antiirradiation dye. The hue of the antihalation or antiirradiation dye is preferably adjusted within the sensitive light region of silver halide.

The pigments are described in various publications such as Japanese Patent Provisional Publication No. 5(1993)-249667, Handbook of Color Index and New Handbook of Pigments, Nippon Ganryo Gijutsu Kyokai (1977).

The antiirradiation dyes are described in Japanese Patent Publications No. 41(1966)-20389, No. 43(1968)-3504, No. 43(1968)-13168, Japanese Provisional Publications No. 2(1990)-39042, U.S. Pat. No. 2,865,752, No. 3,423,207, No. 3,697,037, and British Patents No. 1,030,392, No. 1,100, 546.

The amount of the colorant is usually in the range of 0.01 to 2 g/m$^2$, and preferably in the range of 0.05 to 1 g/m$^2$.

[The other additives]

The light-sensitive material can contain the other additives such as an antifogging agent, a silver development accelerator and a stabilizer. Examples of these compounds include azoles, azaindenes, nitrogen-containing carboxylic acids, phosphoric acids, acetylene compounds and sulfonamides. The azoles and the azaindenes are described in Research Disclosure pages 24 to 25 (1978). The nitrogen-containing carboxylic acids and the phosphoric acids are described in Japanese Patent Provisional Publication No. 59(1984)-168442. The acetylene compounds are described in Japanese Patent Provisional Publication No. 62(1987)-87957. The sulfonamides are described in Japanese Patent Provisional Publication No. 61(1987)-178232.

An aromatic (having a carbon or heterocyclic ring) mercapto compound can also be used as an antifogging agent or a development accelerator. An aromatic heterocyclic mercapto compound, particularly a mercapto triazole derivative is preferred. The mercapto compound can be used in the form of a mercapto silver (silver salt).

These compounds are generally used in an amount of $10^7$ to 1 mol based on 1 mol of the silver halide.

[Development stopping agent]

The development stopping agent can be used in the light-sensitive material to obtain a clear image constantly regardless of the temperature and time for the development process. The development stopping agent can be a compound having a function of neutralizing a base or reacting with a base to reduce the base concentration in the layer to stop development. The agent can also be a compound having a function of mutually reacting with silver or a silver salt to suppress development, after the appropriate development. Examples of the development stopping agents include acid precursors capable of releasing acids upon heating, electrophilic compounds capable of undergoing substitution reaction with a coexisting base upon heating, nitrogen-containing heterocyclic compounds, mercapto compounds, and precursors thereof. The development stopping agent is described in Japanese Patent Provisional Publications No. 62(1987)-253159, No. 2(1990)-42447 and No. 2(1990)-262661.

[Surface active agent]

A surface active agent may be contained in a layer of the light-sensitive material. Various nonionic, anionic, cationic or fluorine surface active agents are available. The surface active agent is described in Japanese Patent Provisional Publication No. 2(1990)-195356. Sorbitan, polyoxyethylene and a fluorine-containing compound are preferred.

[Matting agent]

A matting agent can be added to a back layer, an overcoating layer or an image formation accelerating layer to prevent adhesion of between two light-sensitive materials when the materials are superposed.

Inorganic or organic solid particles are available as the matting agent. The particles are well known in silver halide photography.

Examples of the matting agents include oxides (e.g., silicon dioxide), alkali earth metal salts, natural polymers (e.g., starch, cellulose) and synthetic polymers.

The average particle size of the matting agent is preferably in the range of 1 to 50 $\mu$m. The amount of the matting agent is preferably in the range of 0.01 to 1 g/m$^2$, and more preferably in the range of 0.1 to 0.7 g/m$^2$.

[Polymerization inhibitor]

A polymerization inhibitor may be added to the hardening layer to prevent the dark reaction. Various known polymerization inhibitors are available. Examples of the polymerization inhibitors include nitrosoamines, ureas, thioureas, thioamides, phenol derivatives and amines.

[Exposing step]

The wavelength of the light corresponds to the spectral sensitivity of silver halide. Examples of the light sources include a tungsten lamp, a halogen lamp, a xenon lamp, a xenon flash lamp, a mercury lamp, a carbon arc lamp, various laser means (e.g., semiconductor laser, helium neon laser, argon ion laser, helium cadmium laser), light emitting diode and cathode-ray tube. The wavelength is usually with in the visible, near ultraviolet and near infrared regions. A X-ray and an electron bean are also available.

The amount of the exposure is usually in the range of 0.01 to 10,000 ergs/cm$^2$, and preferably in the range of 0.1 to 1,000 ergs/cm$^2$. The light-sensitive material may be exposed to light through a transparent support.

The exposure of silver halide, namely formation of latent image is influenced with the temperature and humidity at the exposing step. Accordingly, the sensitivity depends on the temperature and humidity. Therefore, the temperature and the humidity under the circumstances of the light source and the light-sensitive material are preferably controlled at constant values. An image recording apparatus having a controlling device is disclosed in Japanese Patent Provisional Publications No. 3(1991)-63143 and No. 3(1991)63637.

In more detail, the temperature is preferably controlled within the range of a constant temperature ±50° C., which is preferably within the range of 5 to 40° C., and more preferably within the range of 10 to 35° C. The humidity in an apparatus containing the light-sensitive material and an optical system is also preferably controlled in the same manner. The humidity is preferably in the range of 10 to 80%RH (relative humidity), more preferably in the range of 15 to 75%RH, and most preferably in the range of 25 to 70%RH.

[Developing step]

The light-sensitive material is developed simultaneously with or after the exposing step. The light-sensitive material is preferably heated to develop the silver halide. However, a wet development using a developing solution is also available.

The heat development can be conducted by placing the light-sensitive material on a heated material (e.g., metal plate, block, roller). The light-sensitive material may be immersed in a heated liquid for the development. Further, the light-sensitive material may be irradiated with an infrared ray. The surface of the light-sensitive material may be open to the air while heating the material from the side of the support. The surface of the light-sensitive material may be covered with the heating means to prevent the air from penetrating into the layers. In the case that the surface is open to the air, a layer of the light-sensitive material preferably contains a polymer having a function of prevent the air from penetrating into the layers.

The heating temperature is preferably in the range of 60 to 200° C., and more preferably in the range of 100 to 150° C. The heating time is preferably in the range of 1 to 180 seconds, and more preferably in the range of 5 to 60 seconds.

A preheat treatment or post-heat treatment can be conducted before or after the heat development. The temperature of the preheat is lower than the heat development temperature, and the time is shorter than the development time. The post-heat treatment can be conducted after the image is formed, for example after removing the unhardened hardening layer.

In the system wherein the unexposed area is hardened, a thermal polymerization initiator or a photopolymerization initiator is preferably contained in the light-sensitive material. Where a thermal polymerization initiator is used, the initiator can function at the heat development to form an initiator radical uniformly. Where the photopolymerization initiator is used, the light-sensitive material is uniformly exposed to light after the developing step. The light source is determined based on the sensitive wavelength of the photopolymerization initiator. Examples of the light sources are described at the exposing step. The exposure amount is usually in the range of $10^3$ to $10^7$ ergs/cm$^2$.

[Removing step]

The unhardened area can be selectively removed to form a polymer image based on a difference in the solubility between the hardened area and the unhardened area.

After the heat development, the light-sensitive material is immersed in a solvent (an etching solution) to conduct the removing step. An organic solvent, an aqueous alkaline solution and a mixture thereof are available as the solvent. The solvent should have a function of dissolving or swelling the unhardened area. Examples of the alkaline compound include sodium hydroxide, potassium hydroxide, sodium carbonate, sodium silicate, potassium silicate, sodium metasilicate, potassium metasilicate, sodium phosphate, potassium silicate, ammonia and aminoalcohols (e.g., monoethanolamine, diethanolamine, triethanolamine). An organic solvent is preferably added to an aqueous etching solution. The organic liquid preferably is an alcohol or an ether. Examples of the alcohols include lower alcohols (e.g., methanol, ethanol, propanol, butanol), alcohols having an aromatic group (e.g., benzyl alcohol, phenethyl alcohol), polyhydric alcohols (e.g., ethylene glycol, diethylene glycol, triethylene glycol, polyethylene glycol) and aminoalcohols described above as the alkaline compounds. Examples of the ethers are cellosolves. The solvent may further contain the other additives such as a surface active agent and a defoaming agent. Commercially available developing solutions are also available. Before the removing step, a light-sensitive layer or other hydrophilic layers may be removed by washing the light-sensitive material with water, or peeling the hydrophilic layers.

The removing step can also be conducted by a sheet based on a difference in the adhesion to the sheet between the hardened area and the unhardened area. The hardened area or the unhardened area is selectively attached to the removing sheet. An image can be formed on the area remaining on the light-sensitive material. The removing sheet can be laminated on the light-sensitive material before the exposing step or the developing step.

[Transferring step]

The obtained image can be transferred to an image receiving material based on a difference in the adhesion to the image receiving material between the hardened area and the unhardened area. The image receiving material can be laminated on the light-sensitive material before the exposing step or the developing step.

[Toning step]

A colored substance (toner) can be attached to the hardened area or the unhardened area. The toner can be selectively attached to the unhardened area based on a difference in the adhesion to the toner between the hardened area and the unhardened area. After the hardened area or the unhardened area is removed, the toner can be attached to the remaining area. Further, the toner can be attached to an adhesive layer, after the hardened area or the unhardened area on the adhesive layer is selectively removed. Furthermore, the toner can be attached to an image receiving material, after the hardened area or the unhardened area is selectively transferred to the image receiving material.

[Dyeing step]

The hardened area or the unhardened area can be selectively dyed to form a visible image. The dyeing step can also be conducted to an image receiving material, after the hardened area or the unhardened area is selectively transferred to the image receiving material.

The obtained image can be used as a printing plate, a color proof, a hard copy or a relief image.

EXAMPLE 1

Preparation of aluminum support

A surface of an aluminum plate (according to JIS-A-1050) having the thickness of 0.24 mm was ground using a nylon brush and an aqueous suspension of pumice stone of 400 mesh. The plate was well washed out with water. The aluminum plate was then immersed for etching in 10% aqueous solution of sodium hydroxide at 70° C. for 60 seconds. The plate was washed out with running water, then neutralized with 20% aqueous solution of nitric acid and washed out with water.

The obtained aluminum plate was subjected to an electrolytic surface-roughening treatment in 1% aqueous solution of nitric acid containing 0.5% aluminum nitrate in an anodically electric amount of 160 coulomb/dm$^2$ using sine wave alternating-corrugated current under such conditions as an anodic voltage of 12.7 V and a cathodically electric amount ratio to an anodically electric amount of 0.9. The center line average height (Ra) of the aluminum plate was 0.6 $\mu$m.

The aluminum plate was immersed in 1% aqueous solution of sodium hydroxide at 40° C. for 30 seconds. The plate was then immersed in 30% sulfuric acid at 55° C. for 1 minute. Further, the plate was subjected to anodizing treatment in 20% aqueous solution of sulfuric acid at a current density of 2 A/dm$^2$ to form an anodic oxide layer having the thickness of 2.5 g/dm$^2$. The plate was washed with water and dried to obtain an aluminum support.

Preparation of pigment dispersion

The following mixture was stirred in a dynomill dispersing device at 3,000 rpm for 1 hour at 45° C. to obtain a pigment dispersion having the average particle size of 0.01 $\mu$m.

| Pigment dispersion | |
|---|---|
| Pigment (Chromofutal Red A2B) | 18 g |
| Allyl methacrylate-methacrylic acid copolymer (copolymerization ratio = 83/17) | 12 g |
| Cyclohexanone | 30 g |
| Propylene glycol monomethyl ether | 40 g |

Formation of hardening layer

The following coating solution was coated and dried on the support to form a hardening layer having the dry thickness of 1.8 $\mu$m.

| Coating solution of hardening layer | |
|---|---|
| Pentaerythritol tetraacrylate | 2.5 g |
| 20 Wt. % propylene glycol monomethyl ether solution of allyl methacrylate-methacrylic acid copolymer (copolymerization ratio = 80/20) | 37.5 g |
| The pigment dispersion | 13.0 g |
| Methyl ethyl ketone | 46.5 g |
| 1 Wt. % methyl ethyl ketone solution of the coupling agent (II-5) (ALCH, Kawaken Fine Chemical Co., Ltd.) | 27.5 g |

Preparation of silver halide emulsion

Gelatin, potassium bromide and water were placed in a vessel and adjusted to pH 9.5 at the room temperature. The following thioether compound ($2.0\times10^{-3}$ mol based on the total amount of silver nitrate) was added to the vessel. Further, an aqueous solution of silver nitrate and an aqueous solution of potassium bromide containing a rhodium ammonium chloride (the molar ratio of rhodium to the total amount of potassium iodide and silver nitrate is $4\times10^{-8}$ mol) were added to the vessel according to a pAg controlled double jet method while keeping the pAg of 9.0 in the reaction vessel to prepare a silver iodobromide emulsion. The emulsion was adjusted to pH 6.0 using sulfuric acid. Further, a potassium bromide solution containing hexachloroiridate(III) salt (the molar ratio of iridium to silver is $10^{-7}$ mol) was twice added to the emulsion at 55° C. and pAg 9.3 according to a double jet method to obtain a core/shell type silver iodobromide emulsion having the following composition.

(Thioether compound)

$$HO—CH_2—CH_2—S—CH_2—CH_2—S—CH_2—CH_2—OH$$

Core: Silver iodobromide (silver iodide content: 8.5 mol %)

Shell: Pure silver bromide

Core/shell: 3/7 (molar ratio of silver)

Average silver iodide content: 2.55 mol %

Average grain size: 0.30 $\mu$m

The grains of the obtained emulsion were monodispersed. In the emulsion, 98% of the grains have a grain size within the range of the average grain size ±40%.

After the emulsion was desalted, a methanol solution of the following sensitizing dyes A and B (A:B=1:2, total amount: $8\times10^{-4}$ mol per 1 mol of silver halide) was added to the emulsion. The emulsion was left for 15 minutes. To the emulsion, the following sodium salt of a thiol compound ($6\times10^{-4}$ mol per 1 mol of silver halide) was added. The emulsion was stirred for 5 minutes, and was adjusted to pH 6.5 and pAg 8.8 to prepare a silver halide emulsion.

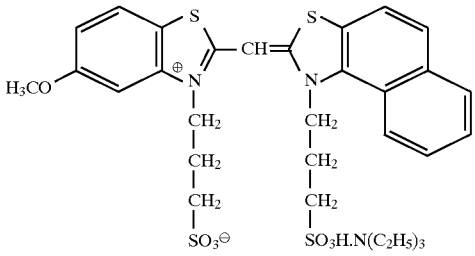

(Sensitizing dye A)

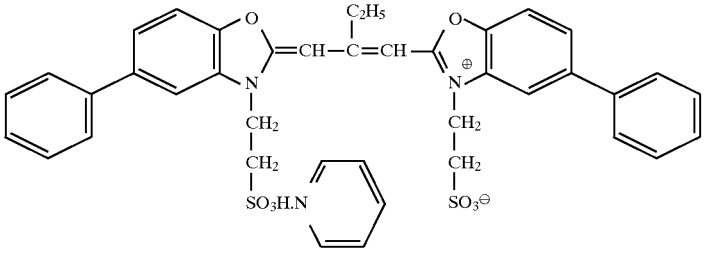

(Sensitizing dye B)

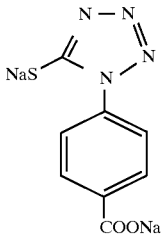

(Sodium salt of thiol)

Preparation of reducing agent dispersion

In 900 g of 2.2 wt. % aqueous solution of polyvinyl alcohol (PVA-205, Kuraray Co., Ltd.), 100 g of powder of the following reducing agent was dispersed using a dynomill dispersing device. The particle size of the reducing agent was not more than about 0.8 μm.

(Reducing agent)

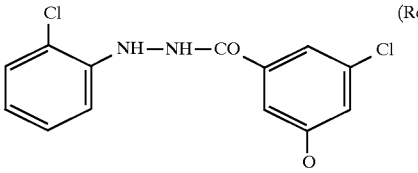

Formation of light-sensitive layer

The following coating solution was coated and dried on the hardening layer to form a light-sensitive layer having the dry coating amount of about 2.0 g/m$^2$.

| Coating solution of light-sensitive layer | |
|---|---|
| Polyvinyl alcohol having the saponification degree of 79.5% (PVA-405, Kuraray Co., Ltd.) | 10.5 g |
| 0.11 Wt. % methanol solution of the following compound (SH-1) | 0.41 g |
| 0.11 Wt. % methanol solution of the following compound (SH-2) | 0.41 g |
| The silver halide emulsion | 0.50 g |
| 5 Wt. % aqueous solution of the following surface active agent | 0.40 g |
| Water | 7.80 g |
| The reducing agent dispersion | 1.20 g |

(SH-1)

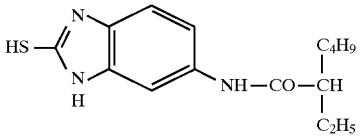

(SH-2)

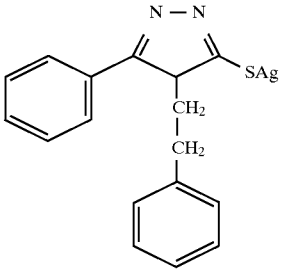

(Surface active agent)

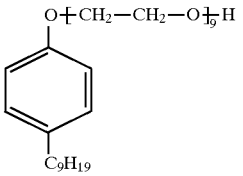

Preparation of base precursor dispersion

In 750 g of 3 wt. % aqueous solution of polyvinyl alcohol (PVA-205, Kuraray Co., Ltd.) was dispersed 250 g of powder of the following base precursor using Dynomill dispersing device. The particle size of the base precursor was not more than about 0.5 μm.

(Base precursor)

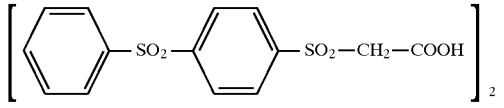

-continued

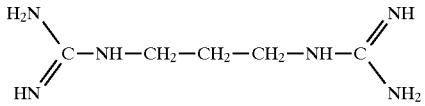

Formation of overcoating layer

The following coating solution was coated and dried on the light-sensitive layer to form an overcoating layer having the dry coating weight of about 4.0 g/m$^2$.

| Coating solution of overcoating layer | |
|---|---|
| Polyvinyl alcohol having the saponification degree of 98.5% (PVA-105, Kuraray Co., Ltd.) | 200.0 g |
| The base precursor dispersion | 1.25 g |
| 5 Wt. % aqueous solution of the surface active agent | 4.0 g |

Preparation of alkaline solution

The following alkaline solution was prepared and adjusted to pH 13.5.

| Alkaline solution | |
|---|---|
| 28 Wt. % aqueous solution of potassium silicate | 125.0 g |
| Potassium hydroxide | 15.0 g |
| Water | 750.0 g |

Image formation

An original film was placed on the prepared light-sensitive material. The material was exposed to light of 500 nm through a band pass filter using a tungsten lump of 500 W for 1.5 second. The aluminum support of the light-sensitive material was placed on a hot plate while covering the surface of the light-sensitive material with a polyethylene terephthalate film. The material was heated at 140° C. for 50 seconds. As a result, a silver image was observed within the exposed area.

The light-sensitive material was washed with water to remove the light-sensitive layer and the overcoating layer. The hardening layer was etched with an aqueous alkaline solution by a brush in an automatic developing machine. The light-sensitive material was well washed with water to form a red polymer relief image on the exposed area of the hardening layer.

The maximum density (Dmax), the minimum density (Dmin), the gray scale (G/S) and the sensitivity (ΔD=0.15) of the obtained image were evaluated. Further, omissions within the hardened area and remaining spots within the unhardened area were observed. The omissions and spots were evaluated as the following three grades.

A: No omissions or spots are observed.

B: Omissions or spots are slightly observed.

C: Omissions or spots are remarkably observed.

The results are set forth in Table 1.

COMPARISON EXAMPLE 1

A light-sensitive material was prepared and evaluated in the same manner as in Example 1, except that the following coating solution of the hardening layer was used. The results are set forth in Table 1.

| Coating solution of hardening layer | |
|---|---|
| Pentaerythritol tetraacrylate | 2.5 g |
| 20 Wt. % propylene glycol monomethyl ether solution of allyl methacrylate-methacrylic acid copolymer (copolymerization ratio = 80/20) | 37.5 g |
| The pigment dispersion | 13.0 g |
| Methyl ethyl ketone | 74.5 g |

TABLE 1

| Sample No. | Coupling agent | Maximum density (Dmax) | Minimum density (Dmin) | Gray scale (G/S) | Omission | Remaining spots |
|---|---|---|---|---|---|---|
| Ex. 1 | II-5 | 1.52 | 0.33 | 4.5/8.0 | A | A |
| Comp. 1 | None | 1.54 | 0.33 | 4.0/7.5 | C | C |

EXAMPLES 2 TO 9

A light-sensitive material was prepared and evaluated in the same manner as in Example 1, except that the coupling agents shown in Table 2 were used in place of the coupling agent (II-5). The amount of the coupling agent is the same as in Example 1. The results are set forth in Table 2.

TABLE 2

| Sample No. | Coupling agent | Maximum density (Dmax) | Minimum density (Dmin) | Gray scale (G/S) | Omission | Remaining spots |
|---|---|---|---|---|---|---|
| Ex. 2 | I-6 | 1.57 | 0.33 | 4.8/8.2 | A | A |
| Ex. 3 | II-4 | 1.54 | 0.33 | 4.5/8.0 | A | A |
| Ex. 4 | II-6 | 1.55 | 0.34 | 4.5/7.8 | A | B |
| Ex. 5 | II-10 | 1.53 | 0.33 | 5.0/8.5 | A | A |
| Ex. 6 | II-11 | 1.52 | 0.33 | 4.8/8.0 | A | A |
| Ex. 7 | III-1 | 1.54 | 0.34 | 5.0/8.2 | A | A |
| Ex. 8 | III-5 | 1.56 | 0.33 | 4.2/7.5 | A | A |
| Ex. 9 | IV-3 | 1.55 | 0.34 | 4.8/8.2 | A | B |

EXAMPLE 10

A light-sensitive material was prepared and evaluated in the same manner as in Example 1, except that the following coating solution of the hardening layer was used. The results are set forth in Table 3.

| Coating solution of hardening layer | |
|---|---|
| Pentaerythritol tetraacrylate | 2.5 g |
| 20 Wt. % propylene glycol monomethyl ether solution of allyl methacrylate-methacrylic acid copolymer (copolymerization ratio = 80/20) | 37.5 g |
| The pigment dispersion | 13.0 g |
| Methyl ethyl ketone | 46.5 g |
| 1 Wt. % methyl ethyl ketone solution of the coupling agent (II-9) (Alumichelate D, Kawaken Fine Chemical Co., Ltd.) | 15.0 g |

COMPARISON EXAMPLE 2

A light-sensitive material was prepared and evaluated in the same manner as in Example 1, except that the following coating solution of the hardening layer was used. The results are set forth in Table 3.

| Coating solution of hardening layer | |
|---|---|
| Pentaerythritol tetraacrylate | 2.5 g |
| 20 Wt. % propylene glycol monomethyl ether solution of allyl methacrylate-methacrylic acid copolymer (copolymerization ratio = 80/20) | 37.5 g |
| The pigment dispersion | 13.0 g |
| Methyl ethyl ketone | 46.5 g |
| 1 Wt. % methyl ethyl ketone solution of the coupling agent (II-9) (Alumichelate D, Kawaken Fine Chemical Co., Ltd.) | 0.37 g |

COMPARISON EXAMPLE 3

A light-sensitive material was prepared and evaluated in the same manner as in Example 1, except that the following coating solution of the hardening layer was used. The results are set forth in Table 3.

| Coating Solution of hardening layer | |
|---|---|
| Pentaerythritol tetraacrylate | 2.5 g |
| 20 Wt. % propylene glycol monomethyl ether solution of allyl methacrylate-methacrylic acid Copolymer (copolymerization ratio = 80/20) | 37.5 g |
| The pigment dispersion | 13.0 g |
| Methyl ethyl ketone | 46.5 g |
| 1 Wt. % methyl ethyl ketone solution of the coupling agent (II-9) (Alumichelate D, Kawaken Fine Chemical Co., Ltd.) | 27.5 g |

TABLE 3

| Sample No. | Amount of agent* | Maximum density (Dmax) | Minimum density (Dmin) | Gray scale (G/S) | Omission | Remaining spots |
|---|---|---|---|---|---|---|
| Ex. 10 | 1.1 | 1.55 | 0.33 | 4.8/8.5 | A | A |
| Comp. 1 | 0.03 | 1.54 | 0.33 | 4.5/7.5 | C | C |
| Comp. 2 | 37.2 | 1.57 | 0.50 | 5.0/9.5 | C | C |

(Remark)
Amount of agent* means the amount of the coupling agent (wt. %) based on the total amount of the light-sensitive layer and the hardening layer.

EXAMPLE 11

To the coating solution of the hardening layer used in Comparison Example 1, 3.50 g of the base precursor dispersion and 8.16 g of the reducing agent dispersion used in example 1 were added. The mixture was dispersed in a homogenizer.

The coupling agent (I-6) (KBM503, Shinetsu Chemical Industry Co., Ltd.) was dropwise added to 1 wt. % aqueous solution of acetic acid, and the mixture was stirred for 60 minutes to obtain 1 wt. % aqueous solution of the coupling solution.

To the above-obtained dispersion, 27.5 g of the aqueous solution of the coupling agent, 3.40 g of the silver halide emulsion used in Example 1 and 2.80 g of 0.11 wt. % methanol solution of the compound (SH-1) were added. The mixture was emulsified by a homogenizer to prepare a coating solution of a light-sensitive hardening layer. The coating solution was coated on the aluminum support used in Example 1, and dried to form a light-sensitive hardening layer having the dry thickness of 3 $\mu$m.

On the light-sensitive hardening layer, 10 wt. % aqueous solution of polyvinyl alcohol having the saponification degree of 98.5% (PVA-105, Kuraray Co., Ltd.) was coated and dried to form an overcoating layer having the dry thickness of 2 μm.

The prepared light-sensitive material was evaluated in the same manner as in Example 1. The results are set forth in Table 4.

TABLE 4

| Sample No. | Coupling agent | Maximum density (Dmax) | Minimum density (Dmin) | Gray scale (G/S) | Omission | Remaining spots |
|---|---|---|---|---|---|---|
| Ex. 11 | I-6 | 1.46 | 0.34 | 5.5/9.0 | A | A |

As is evident from the results shown in Tables 1 to 4, the light-sensitive material of the present invention can form a clear image of high discrimination, which is free from the problems of the omission within the hardened area and the remaining spots within the unhardened area.

I claim:

1. A light-sensitive material which comprises a support, a hardening layer and a light-sensitive layer in that order, said hardening layer containing an ethylenically unsaturated cross-linkable polymer having an acidic group, silver halide being contained in said light-sensitive layer, a reducing agent being contained in said hardening layer or said light-sensitive layer, and a base precursor in the form of a salt of a carboxylic acid with a base being contained in the light-sensitive layer or an overcoating layer provided on the light-sensitive layer, wherein the hardening layer further contains a coupling agent in an amount of 0.01 to 15 wt. %.

2. The light-sensitive material as claimed in claim 1, wherein the light-sensitive layer further contains a polyvinyl alcohol having a saponification degree of not less than 80%.

3. The light-sensitive material as claimed in claim 1, wherein the overcoating layer further contains a polyvinyl alcohol having a saponification degree of not less than 80%.

4. The light-sensitive material as claimed in claim 1, wherein the coupling agent is a silane coupling agent, an aluminum coupling agent, a titanate coupling agent or a zircoaluminate coupling agent.

5. The light-sensitive material as claimed in claim 4, wherein the coupling agent is the silane coupling agent represented by the formula (Ia), (Ib), (Ic), (Id) or (Ie):

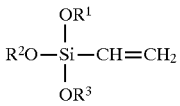
(Ia)

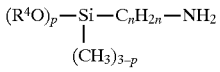
(Ib)

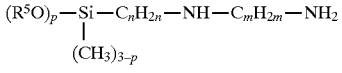
(Ic)

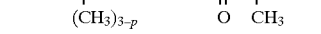
(Id)

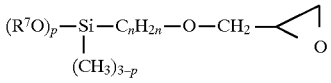
(Ie)

wherein each of $R^1$, $R^2$, $R^3$, $R^4$, $R^5$, $R^6$ and $R^7$ is an alkyl group having 1 to 4 carbon atoms or an alkoxyalkyl group having 2 to 4 carbon atoms; each of n and m is 2 or 3; and p is 2 or 3.

6. The light-sensitive material as claimed in claim 4, wherein the coupling agent is the aluminum coupling agent represented by the formula (IIa), (IIb) or (IIc):

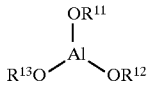
(IIa)

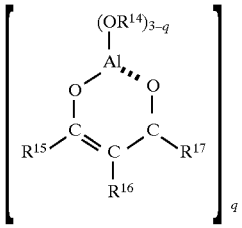
(IIb)

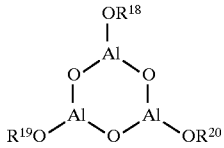
(IIc)

wherein each of $R^{11}$, $R^{12}$, $R^{13}$ and $R^{14}$ is an alkyl group having 2 to 18 carbon atoms; $R^{15}$ is an alkyl group having 1 to 18 carbon atoms; $R^{16}$ is hydrogen or an alkyl group having 1 to 6 carbon atoms; $R^{17}$ is an alkyl group having 1 to 18 carbon atoms or an alkoxy group having 1 to 18 carbon atoms; each of $R^{18}$, $R^{19}$ and $R^{20}$ is an alkyl group having 2 to 18 carbon atoms or an acyl group having 2 to 18 carbon atoms; and q is 1, 2 or 3.

7. The light-sensitive material as claimed in claim 4, wherein the coupling agent is the titanate coupling agent represented by the formula (IIIa), (IIIb), (IIIc) or (IIId):

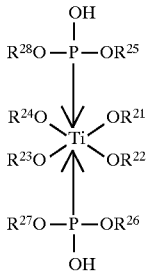
(IIIa)

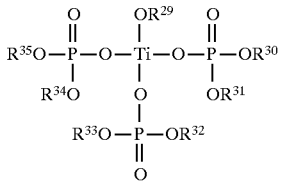
(IIIb)

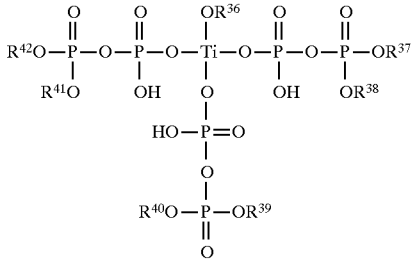
(IIIc)

-continued

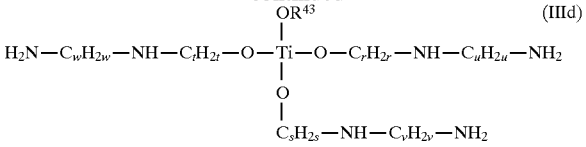

(IIId)

wherein each of $R^{21}$, $R^{22}$, $R^{23}$, $R^{24}$, $R^{25}$, $R^{26}$, $R^{27}$, $R^{28}$, $R^{29}$, $R^{30}$, $R^{31}$, $R^{32}$, $R^{33}$, $R^{34}$, $R^{35}$, $R^{36}$, $R^{37}$, $R^{38}$, $R^{39}$, $R^{40}$, $R^{41}$, $R^{42}$ and $R^{43}$ is an alkyl group having 1 to 18 carbon atoms; and each of r, s, t, u, v and w is 1, 2 or 3.

8. The light-sensitive material as claimed in claim 4, wherein the coupling agent is the zircoaluminate coupling agent represented by the formula (IV):

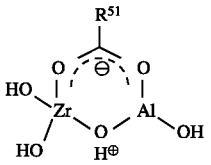

(IV)

wherein $R^{51}$ is an alkyl group having 1 to 18 carbon atoms, an aminoalkyl group having 1 to 18 carbon atoms, a carboxyalkyl group having 2 to 18 carbon atoms or a mercaptoalkyl group having 1 to 18 carbon atoms.

9. The light-sensitive material as claimed in claim 1, wherein the hardening layer contains the coupling agent in an amount of 0.05 to 10 wt. %.

* * * * *